US007563334B2

(12) United States Patent
Zhang et al.

(10) Patent No.: US 7,563,334 B2
(45) Date of Patent: Jul. 21, 2009

(54) TWO-WAY SHAPE MEMORY SURFACES

(75) Inventors: Yijun Zhang, Albany, CA (US); Yang T. Cheng, Troy, MI (US); David S. Grummon, E. Lansing, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 287 days.

(21) Appl. No.: 11/560,520

(22) Filed: Nov. 16, 2006

(65) Prior Publication Data

US 2007/0163686 A1 Jul. 19, 2007

Related U.S. Application Data

(60) Provisional application No. 60/739,482, filed on Nov. 23, 2005.

(51) Int. Cl.
*C22F 1/10* (2006.01)

(52) U.S. Cl. ..... 148/563; 148/675

(58) Field of Classification Search ..... 148/563
See application file for complete search history.

(56) References Cited

U.S. PATENT DOCUMENTS

| | | | | |
|---|---|---|---|---|
| 4,930,494 | A * | 6/1990 | Takehana et al. | 600/145 |
| 6,084,849 | A * | 7/2000 | Durig et al. | 369/126 |
| 2002/0113499 | A1 * | 8/2002 | von Behrens et al. | 310/12 |
| 2004/0202888 | A1 * | 10/2004 | Cheng et al. | 428/651 |
| 2007/0079911 | A1 * | 4/2007 | Browne | 148/563 |

* cited by examiner

*Primary Examiner*—George Wyszomierski

(57) ABSTRACT

A method for forming a two-way shape memory surface includes thermomechanically training a shape memory alloy under substantially constant indentation strain. Thermomechanical training includes removeably securing an indenter to a surface of the shape memory alloy in its martensite phase, so that an indent is formed in the surface. The shape memory alloy is then heated to its austenite phase while the indenter is secured thereto. The shape memory alloy is then quenched to its martensite phase while the indenter is secured thereto. After thermomechanical training, the shape memory alloy surface exhibits a first indent depth when in its martensite phase, and a second, different indent depth when in its austenite phase. Also disclosed herein is a method for forming one-way and two-way reversible surface protrusions on shape memory alloys.

15 Claims, 4 Drawing Sheets

TWO-WAY SHAPE MEMORY SURFACES

CROSS REFERENCE TO RELATED APPLICATIONS

This application claims the benefit of U.S. Provisional Patent Application Ser. No. 60/739,482, filed on Nov. 23, 2005.

TECHNICAL FIELD

The present disclosure relates generally to shape memory surfaces of shape memory alloys, and more particularly to two-way shape memory surfaces.

BACKGROUND

Shape memory alloys (SMA) have been applied to a wide variety of applications, in part, because of their ability to undergo a reversible phase transformation. It has been shown that the thermally induced martensite to austenite transformation of indented SMA allows for indent recovery on the microscale and nanoscale.

Many SMAs exhibit a one-way phenomenon, where, upon subsequent cooling (i.e. cooling after the initial shape memory effect is exhibited) from the austenite to the martensite phase, the SMA does not return to the previously deformed shape. As such, these materials may be limited in the applications in which they may be used.

Other SMAs exhibit a two-way phenomenon, where, upon subsequent cooling of the SMA from the austenite to the martensite phase, the SMA returns to the deformed or remembered shape. Two-way shape memory behavior may be realized in shape memory alloys via thermomechanical treatments, or training, which include thermomechanical cycling, aging under external stress, and plastic deformations. Despite the versatile available training methods, the basic mechanism of the two-way shape memory effects remains somewhat elusive. It is believed that residual martensite, dislocations resulting from training, or dislocations and their correspondent internal stress fields may cause the two-way effect. These methods are based on relatively simple loading conditions, such as uniaxial tensile, shearing, or bending, which may affect the stability and magnitude of the two-way shape memory behavior. While these methods allow two-way shape memory effects in the form of elongation, compression, torsion, and bending, these methods generally do not form shape memory surfaces with a variety of features.

As such, it would be desirable to provide other methods for forming a variety of two-way shape memory surfaces.

SUMMARY

The present disclosure provides methods for forming two-way shape memory effects on the surfaces of shape memory alloys. One embodiment includes a method for forming a depth-recoverable indentation on the surface of the shape memory alloys. The method includes thermomechanically training the shape memory alloy under substantially constant indentation strain. Thermomechanical training includes removeably securing an indenter to the surface of the shape memory alloy in its martensite phase to make an indentation in the surface. The shape memory alloy is then heated to its austenite phase while the indenter is secured thereto. The shape memory alloy is quenched to its martensite phase while the indenter is secured thereto. After one or more cycles of thermomechanical training, the shape memory alloy surface exhibits a first indent depth when in its martensite phase, and a second, different indent depth when in its austenite phase.

An alternate embodiment of forming a depth-recoverable indentation on the surface of the shape memory alloys includes indenting, under a substantially constant load, a shape memory alloy in its martensite phase. The strained indenting process forms plastic deformations in the shape memory alloy that impart two-way shape memory surface characteristics.

Also disclosed herein is a method for forming two-way reversible surface protrusions on shape memory alloys. The method includes removing at least one previously formed reversible indentation from a surface of the shape memory alloy in its martensite phase. The SMA is then heated above its austenite start temperature, which forms a protrusion at a site where the previously formed reversible indent was removed. The SMA is then cooled to its martensite start temperature, which causes the protrusion to return to a substantially flattened shape.

BRIEF DESCRIPTION OF THE DRAWINGS

Features and advantages of the present disclosure will become apparent by reference to the following detailed description and drawings, in which like reference numerals correspond to similar, though not necessarily identical components. For the sake of brevity, reference numerals or features having a previously described function may not necessarily be described in connection with other drawings in which they appear.

DETAILED DESCRIPTION OF THE EMBODIMENTS

Shape memory alloys (SMAs) typically exist in several different temperature-dependent phases. Non-limitative examples of these phases include the martensite and austenite phases. Generally, and as used herein, the martensite phase refers to the more deformable (lower modulus), lower temperature phase, whereas the austenite phase refers to the more rigid, higher temperature phase.

Examples of suitable shape memory alloy materials include, but are not limited to copper based alloys (non-limitative examples of which include copper-zinc alloys, copper-aluminum alloys, copper-gold alloys, and copper-tin alloys), gold-cadmium based alloys, indium-titanium based alloys, indium-cadmium based alloys, iron-platinum based alloys, iron-platinum based alloys, iron-palladium based alloys, iron-silicon based alloys, manganese-copper based alloys, nickel-titanium based alloys, nickel-aluminum based alloys, nickel-gallium based alloys, silver-cadmium based alloys, and/or the like, and/or combinations thereof. It is to be understood that the alloys may be binary, ternary, or any higher order so long as the alloy composition exhibits a shape memory effect, e.g., canceling the mechanical deformation at the martensite phase when the material is heated to its austenite phase.

Embodiments of the method disclosed herein may advantageously form materials having surfaces configured to exhibit two-way shape memory effects. Furthermore, the materials may be applied as a surface material on a structure or a substrate, thus providing the structure or substrate with two-way surface characteristics.

Figure 1:
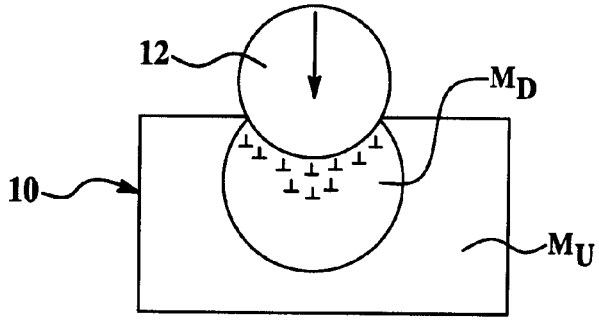
FIG. 1 is a schematic diagram depicting the formation of an embodiment of a two-way shape memory surface having a depth-recoverable indentation.

Referring now to FIG. 1, a method for forming one embodiment of a two-way shape memory alloy 10 is schematically depicted. Generally, the method includes thermomechanically training the shape memory alloy 10 under substantially constant indentation strain.

The shape memory alloy is cooled to its martensite phase M (i.e., to its martensite finish temperature $M_f$) to ensure the shape memory alloy 10 is in its undeformed martensite phase $M_u$. An indenter 12 is removeably secured to the shape memory alloy 10, thereby forming an indentation in the surface of the alloy 10. In an embodiment, the indenter 12 is secured to the alloy 10 via a clamping device. A load is applied to the indenter 12 to form an indentation of a desirable indent depth. It is to be understood that the load applied to the indenter 12 may be normal to the surface of the SMA 10, tangential to the surface of the SMA 10, or combinations thereof.

In an embodiment, the indenter 12 may be spherical, pyramidal, or conical, though it is to be understood that the shape and size of the indenter 12 may be any suitable size, regular shape, and/or non-regular shape, as desired. Depending on the indenter 12 selected and the load applied, the resulting shape may be an indentation or a scratch. Generally, the geometry and size of the indentations and/or scratches may be controlled by the shape and load of the indenter 12.

Dislocations (illustrated by the⊥) and deformation of the material 10 accommodate the indenter 12 displacement. Generally, deeper indentation of the indenter 12 generates dislocations and associated stress anisotropy within the martensite phase M, which facilitate the growth of oriented martensite variants during austenite-to-martensite transformation. For example, when cooled from the austenite phase A, the martensite variants align with a certain direction that is energetically favored over variants with other directions. The preferential nucleation and growth of these directional martensite variants macroscopically enable the SMA 10 to "remember" its low temperature shape.

After a desirable indent depth is obtained, the shape memory alloy 10 (with the indenter 12 secured thereto) is heated to its austenite phase (i.e., to its austenite finish temperature $A_f$). Without being bound to any theory, it is believed that the low temperature shape (i.e. the deformed martensite $M_D$) is induced into the SMA 10 by constraining the high temperature recovery. The stress induced on the SMA 10 from the indenter 12 increases as the temperature rises to the SMA's austenite finish temperature $A_f$. The SMA 10, in its austenite phase A, attempts to recover its initial shape, however, the recovery is impeded by the indenter 12. The heating may take place at a predetermined time and temperature, both of which may be determined by, at least in part, the SMA 10 selected.

After heating, the SMA 10, having the indenter 12 secured thereto, is quenched to its martensite phase (i.e., to its martensite finish temperature $M_f$). The stress upon the SMA 10 is relieved as cooling takes place, in part, because the SMA 10 is moving into its martensite phase M and the indenter 12 is able to relax into the SMA 10.

The indenting, heating, and cooling generally complete a cycle of the thermomechanical training. The surface may exhibit indentation depth recovery after one training cycle. However, it is to be understood that the training cycle may be repeated as many times as may be desirable. In an embodiment, the cycle is repeated about 30 times.

Another method for forming a two-way shape memory surface capable of indentation depth recovery includes indenting, under a substantially constant load, a shape memory alloy 10 in its martensite phase M. The strained indentation forms plastic deformations in the shape memory alloy 10 that impart the two-way shape memory surface characteristics. Generally, the indentation does not fully recover when heated from the martensite phase M to the austenite phase A, leaving residual indents. It is to be understood that the indenting process may be accomplished by sliding an indenter 12 (under strain) through a surface of the shape memory alloy 10 when in its martensite phase M. The resulting indentation may be in the form of a spherical indent or a scratch (e.g., lines, curves, loops, or the like).

Figure 2:
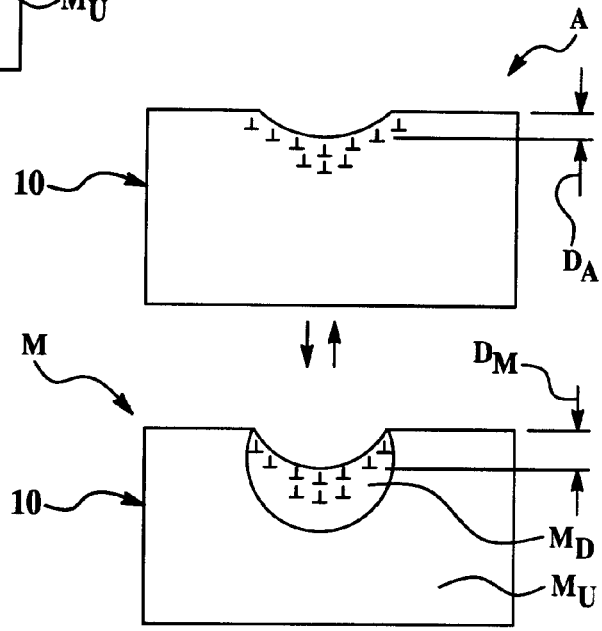
FIG. 2 is a schematic diagram depicting the reversibility of the two-way shape memory surface formed in FIG. 1.

Referring now to FIG. 2, the reversibility of the trained SMA 10 surface is depicted. It is to be understood that the trained shape memory alloy surface exhibits a first indent depth $D_M$ when in its martensite phase M, and exhibits a second, different indent depth $D_A$ in its austenite phase A.

The low temperature martensite phase M shape memory alloy 10 may include martensite variants that are able to align with the shear components of the externally applied stress (from the indenter 12) and accommodate deformation strain. When heated to the austenite phase A, the martensite variants transform to the high-symmetry austenite phase A, canceling the deformation strain and attempting to "remember" the original shape. In this embodiment, the extent of the recovery is determined, at least in part, by the shape and load of the indenter 12. It is believed that the magnitude of recovery decreases with increasing indentation load. As such, two different indent (or scratch) depths may be achieved by the SMA surface.

Figure 3:
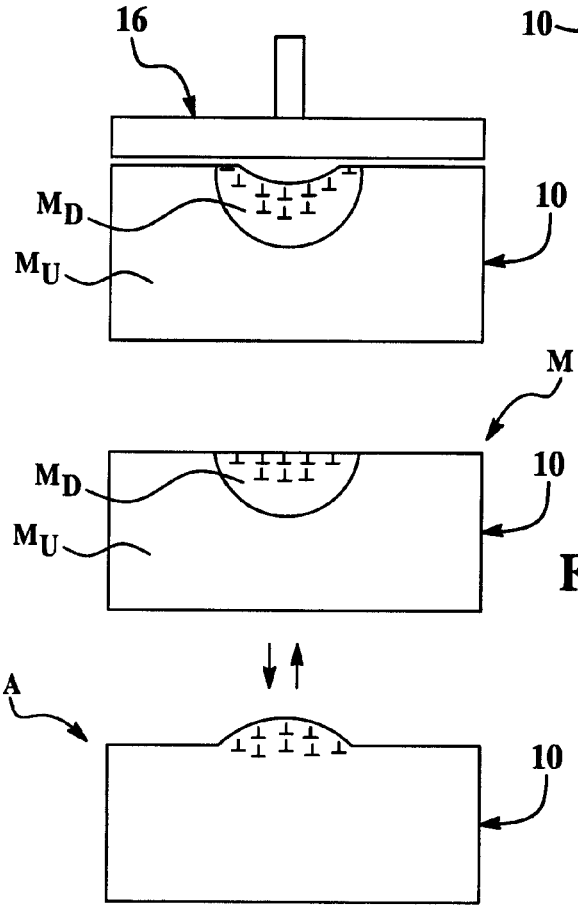
FIG. 3 is a schematic diagram depicting the formation and reversibility of an alternate embodiment of a two-way shape memory surface having a recoverable protrusion.

The formation of indents, scratches, or the like in the SMA 10 are believed to introduce dislocations and stress anisotropy in the SMA 10, which may aid in promoting indentation two-way effects, and which may also lead to the formation of reversible surface formations (see FIG. 3).

Referring now to FIG. 3, shape memory alloys 10 having residual indents, scratches, or the like (i.e., those remaining after heating to the austenite phase A) may exhibit surface protrusion formations. It is to be understood that the indents may be formed via any suitable method, including the methods previously described. Generally, a reversible depth change (such as that described herein in reference to FIGS. 1 and 2) may become a reversible surface protrusion. A one-way indent may become a one-way surface protrusion.

FIG. 3 illustrates the formation of a two-way reversible surface protrusion. The residual indent/scratch exhibits a two-way effect when transitioned from its martensite phase M to its austenite phase A, and vice versa. The reversible indent is removed from the surface of the SMA 10 (while in its martensite phase M) via any suitable technique to form a substantially flat surface. In an embodiment, the indent is removed via a mechanical polishing/grinding process, chemical etching, or combinations thereof (e.g. chemical/mechanical polishing (CMP)). It is to be understood that any desired process may be used that is capable of substantially evenly removing the material of the sample. A device capable of achieving this removal is schematically shown in FIG. 3 and generally depicted at reference numeral 16. It is to be understood that while some of the SMA 10 outside the indent/scratch may be removed by the polishing process, the microstructure and stress distribution beneath the indent/scratch remain substantially intact. As such, the two-way (or one-way depending on the type of indent removed) shape memory effect gives rise to a surface protrusion instead of an indent.

Heating the SMA 10 above its austenite start temperature $A_s$ (to its austenite phase A) causes a protrusion to form in the surface of the shape memory alloy 10 at a site where the indent was removed. Cooling the SMA 10 below its martensite start temperature $M_s$ (to its martensite phase M) causes the protrusion to return to a substantially flattened shape. It is to be understood that generally the protrusion exhibits a similar shape and size (e.g., height) to the indent or scratch that is removed. As such, it is believed that the removal process does not substantially affect the two-way shape memory effect adversely, which may be due, at least in part, to the fact that the deformed region under the indent is larger than the indent itself.

In an embodiment where a one-way indent is removed, it is to be understood that the resulting one-way surface protrusion may form upon heating, but may not recover its flattened shape upon cooling.

Furthermore, intricate patterns (which may be regular or random) of the surface protrusions may be efficiently laid out by arranging positions of indentation(s) or length and direction of scratch(es) as desired during their formation process. Further, the indentations, scratches, and/or protrusions may have a size (e.g., height and/or width) equal to or greater than about 2 nm. Generally, the size limitation is imposed by practical conditions (e.g., thickness of the specimen), which may be up to meters. Still further, in the embodiments disclosed herein, it is to be understood that one or an array of indent(s), scratch(es), and/or protrusion(s) may be formed.

To further illustrate embodiment(s) of the present disclosure, the following examples are given. It is to be understood that these examples are provided for illustrative purposes and are not to be construed as limiting the scope of embodiment(s) of the present disclosure.

EXAMPLE 1

A NiTi alloy was purchased from Special Metals Corp. (located in New Hartford, N.Y.). The nominal composition was 50.32 atomic % Ni and 49.68 atomic % Ti. The material was then electrical-discharge machined to small pieces with dimensions of about 2.45 cm×2.45 cm×1 cm. Surface roughness was reduced to about 0.5 μm in three steps of mechanical polishing using 3 μm, 1 μm, and 0.5 μm grit size diamond paste, respectively.

The NiTi was cooled in liquid nitrogen for about 5 minutes to ensure the material was in its full martensite phase. A 3.175 mm diameter tungsten carbide ball was then clamped into the SMA at an indentation depth of about 170 μm using a steel c-clamp with a fixed number of rotations. The whole fixture was placed in a resistance-heating oven for about 2 minutes to reach 423±10K. After heating, the whole fixture was quenched into ice water for about 2 minutes, which concluded one training cycle. 30 training cycles were performed.

The martensite and austenite start and finish temperatures ($M_s$, $M_f$, $A_s$, and $A_f$, respectively) were measured from a small piece of SMA cut from the trained NiTi SMA using a TA 2920 Modulated Differential Scanning Calorimeter. The phase transformation temperatures were: $A_s$=350K, $A_f$=404K; $M_s$=344K, and $M_f$=287K, respectively.

The profile of indents was measured using a Wyko NT 1000 optical surface profilometer (available from Veeco Instruments Inc., located in Woodbury, N.Y.). A thermoelectric cooler (available from Marlow Industries Inc., located in Dallas, Tex.) was placed below the sample for heating and cooling. A thermocouple was taped onto the side of the SMA to measure the temperature. The profiles of the indents were measured after the SMA was heated to 400±5K, and again after the SMA was cooled to 300±3K.

Figure 4:
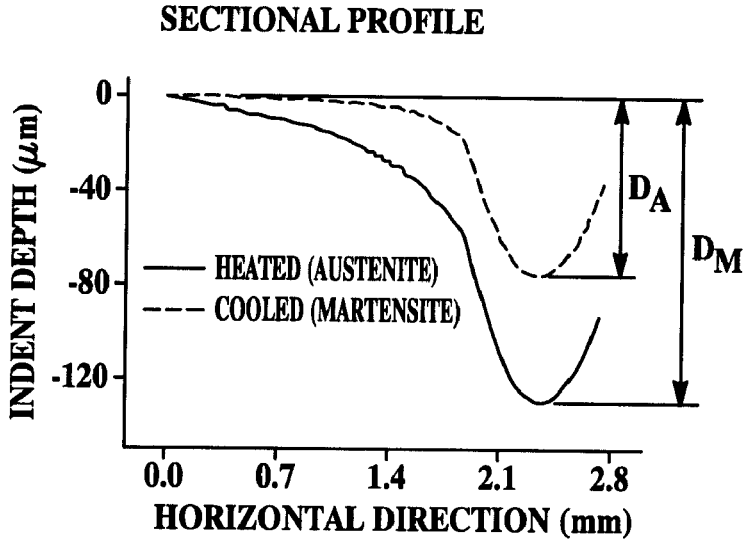
FIG. 4 is a graph depicting the indent depth of a two-way shape memory surface in its austenite phase and in its martensite phase.

FIG. 4 is a graph depicting the cross-section profiles of the heated and cooled indent. $D_A$ is the indent depth after heating the SMA to 400±5K, which is approximately $A_f$, so the NiTi was in the austenite phase A. $D_M$ is the indent depth after cooling the SMA to ambient temperature of 300±3K, which is approximately $M_f$, so the SMA was in the martensite phase M.

After the first heating step, the indent depth decreased from the original indent depth of about 170 μm to about 80 μm (FIG. 5), an approximately 47% indent depth recovery. After cooling to the ambient temperature of 300K, the indent depth increased from $D_A$ of about 80 μm to $D_M$ of about 140 μm, an approximately 75% increase in the depth of the indent. The subsequent heating-cooling cycles produced a substantially constant indent depth ratio, $(D_M-D_A)/D_M$, of about 45% (see FIG. 6).

Figure 5:
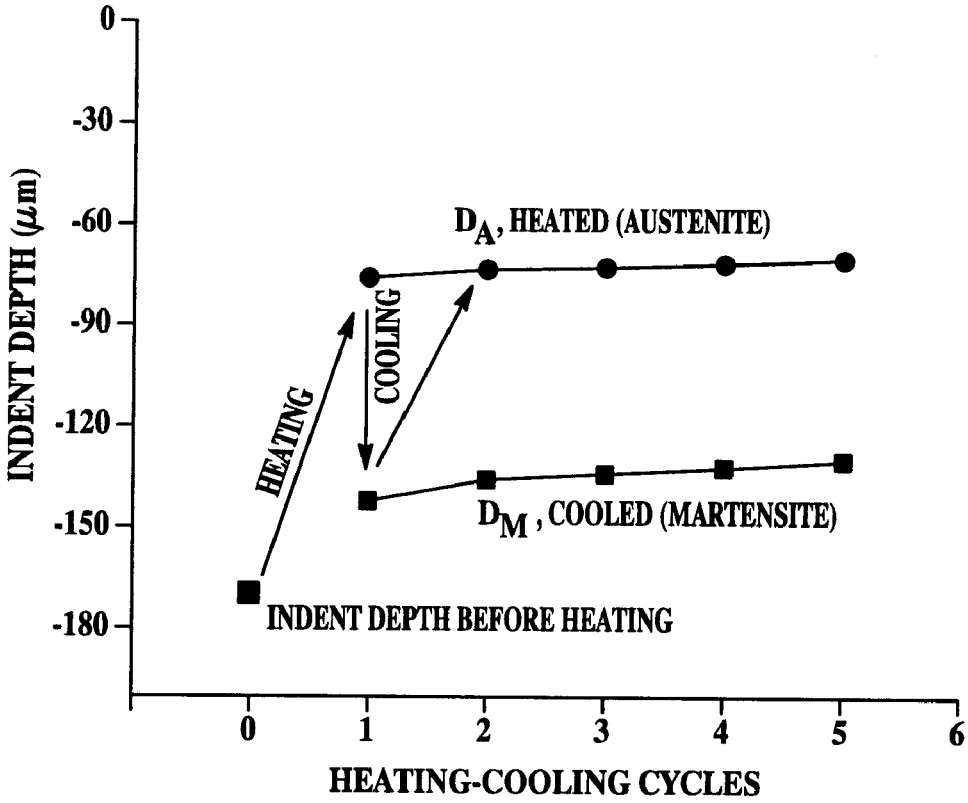
FIG. 5 is a graph depicting the indent depth change of a two-way shape memory surface over several thermal cycles.
Figure 6:
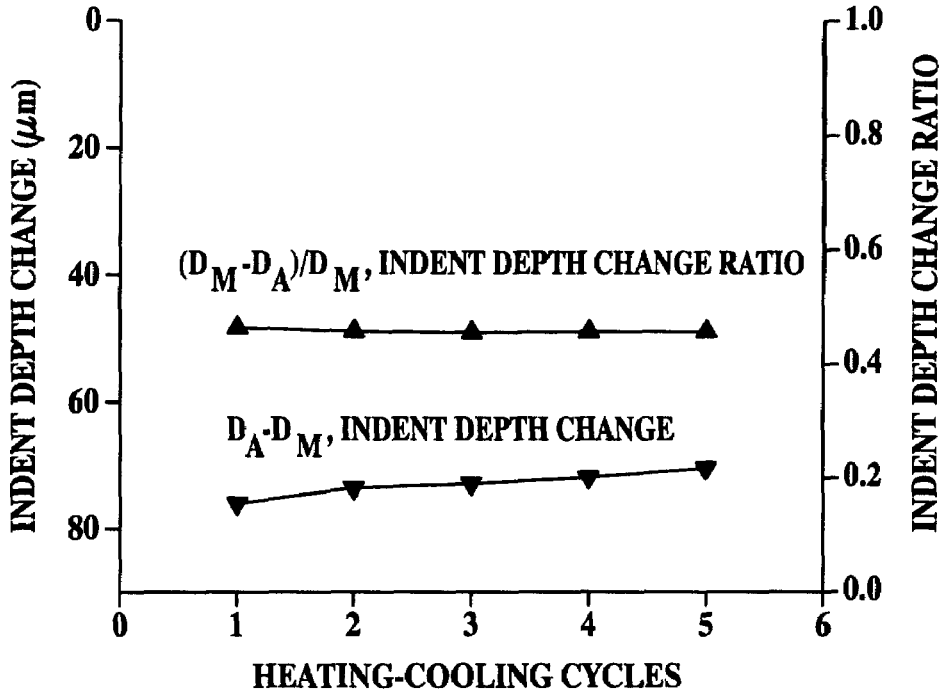
FIG. 6 is a graph depicting the indent depth change ratio and the absolute indent depth change of a two-way shape memory surface.

FIGS. 5 and 6 demonstrate two-way depth recovery of spherical indentations in a NiTi alloy formed by an embodiment of the method disclosed herein. The two-way indent depth change was relatively stable over the five heating-cooling cycles tested. Both $D_A$ and $D_M$ slightly increased over the thermal cycles, with a small decrease in the two-way depth change $D_A-D_M$. The depth changed most significantly between the first and second thermal cycles, where $D_A$ increased about 2.5 μm, $D_M$ increased about 6.3 μm, and $D_A-D_M$ increased about 3.7 μm. As depicted in the figures, the values substantially stabilized over the next 4 cycles with $D_A$ increasing about 0.75 μm/cycle, $D_M$ increasing 1.4 μm/cycle, and $D_A-D_M$ increasing about 0.65 μm/cycle.

It is noticeable in FIG. 5 that the area around the indent had a "sinking-in" effect in the martensite phase M, but was leveled in the austenite phase A. In this example, the size of the sinking-in area was about 1 mm, which was about 10 times the depth of the indent. This sinking-in area and its reversible change over heating-cooling cycles indicate that the method disclosed herein may affect not only the microstructures beneath the indenter 12, but also a relatively large portion of the SMA around the indent.

EXAMPLE 2

A NiTi alloy was purchased from Special Metals Corp. The nominal composition was 50.32 atomic % Ni and 49.68 atomic % Ti. The material was then electrical-discharge machined to small pieces with dimensions of about 2.45 cm×2.45 cm×1 cm. Surface roughness was reduced to about 0.18 μm in three steps of mechanical polishing using 6 μm, 1 μm, and 0.25 μm grit size diamond paste, respectively.

The NiTi was cooled in liquid nitrogen for about 5 minutes to ensure the material was in its martensite phase. A 3×3 matrix of spherical indents was created on the NiTi surface using a 1.59 mm diameter steel ball indenter under 980N load, and a scratch was made with a 107 μm tip radius conical indenter under 15N load. The NiTi was then heated to about 423K on a hot plate for about 10 minutes to let the spherical indent recover, i.e., transform from the martensite phase M to the austenite phase A. It was cooled again in liquid nitrogen for 5 minutes.

The profiles of the indents were taken after the trained SMA was heated to 400±2K and again cooled to 300+2K. The residual indents and scratch were then removed by a mechanical polishing procedure. The profiles of surface relief structures were then measured.

Figure 7:
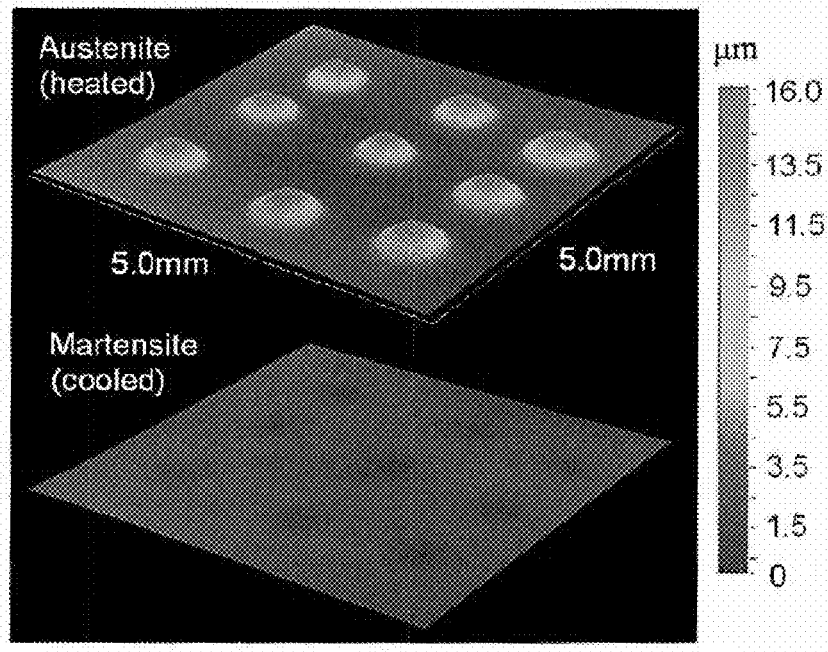
FIG. 7 is a color rendering depicting a 3×3 matrix of circular two-way reversible surface protrusions.
Figure 8:
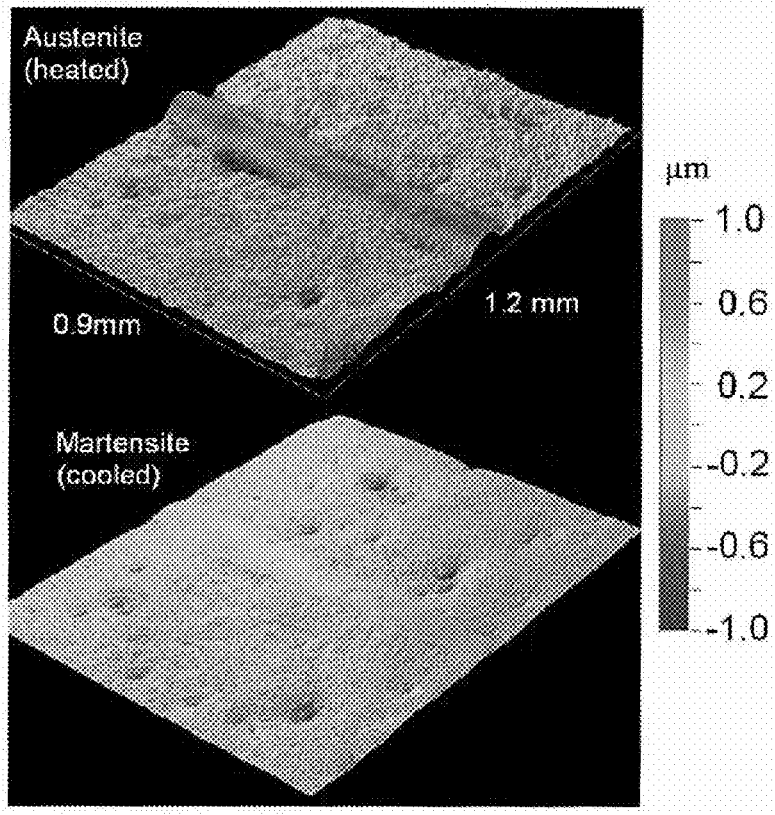
FIG. 8 is a color rendering depicting a line (scratch) two-way reversible protrusion.

FIG. 7 shows the 3×3 matrix of circular protrusions and FIG. 8 shows a line (scratch) protrusion after the planarized SMAs were heated to about 400K. The peak height (generally depicted by the color orange-red) of the circular protrusions is about 13.6±0.1 μm, over the first five heating-cooling cycles. The height (generally depicted by the color orange-red) of the line protrusion is about 0.8±0.05 μm, over the first five heating-cooling cycles. The protruding structures disappear when the SMAs are cooled down to about 300K. With materials formed with two-way indents/scratches, the process is reversible over many thermal cycles.

Figure 9:
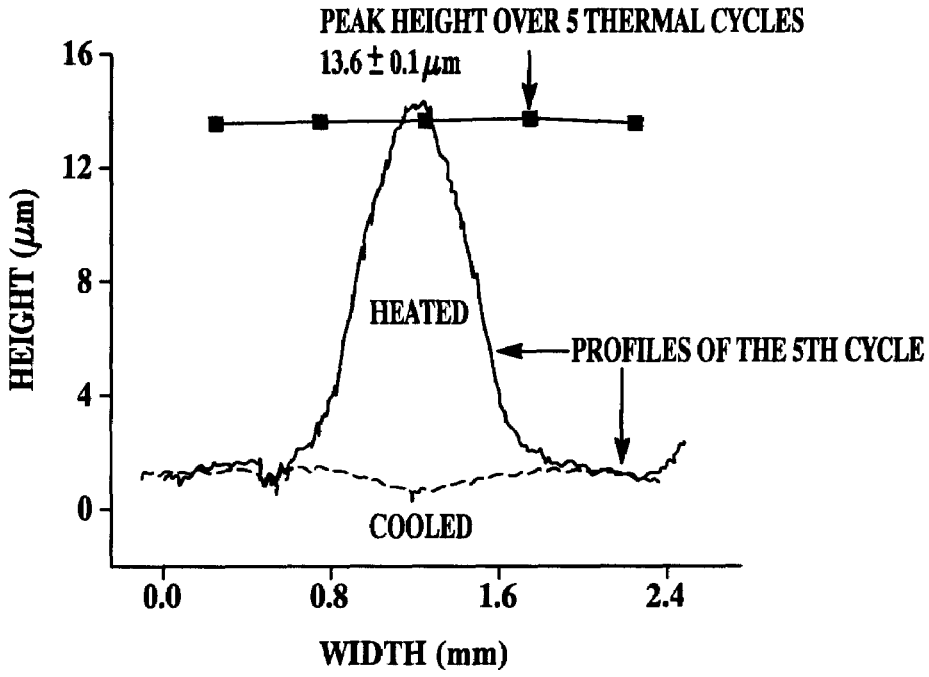
FIG. 9 depicts cross-sectional profiles of the circular surface protrusions of FIG. 7 in the heated austenite phase and the cooled martensite phase; the peak height of the circular protrusions over five thermal cycles is also depicted.

FIG. 9 depicts the cross-sectional profile of the circular surface relief in the heated austenite phase A and the cooled martensite phase M. The peak height of the circular protrusions over five thermal cycles is also depicted.

Embodiments of the methods and materials disclosed herein may provide many advantages, including, but not limited to the following. The material capable of two-way reversible indent depth change may be used in many applications where controlled reversible changes in surface roughness, texture, and topography are desired, including information storage, optical communication devices, micro-fluidic instruments for drug delivery, and smart tribological surfaces for friction and wear control. The surface protrusions may also be used in a variety of applications, including in optical devices, tribological devices, and micro-electro-mechanical devices.

While several embodiments have been described in detail, it will be apparent to those skilled in the art that the disclosed embodiments may be modified. Therefore, the foregoing description is to be considered exemplary rather than limiting.

The invention claimed is:

1. A method for forming a two-way shape memory surface, comprising:

thermomechanically training a shape memory alloy under substantially constant indentation strain, the thermomechanical training including:

removeably securing an indenter to the shape memory alloy in its martensite phase, thereby forming an indent in a surface thereof;

heating the shape memory alloy to its austenite phase, while the indenter is secured thereto; and quenching the shape memory alloy to its martensite phase, while the indenter is secured thereto;

wherein after thermomechanical training, the shape memory alloy surface exhibits a first indent depth in its martensite phase and a second, different indent depth in its austenite phase.

2. The method as defined in claim 1 wherein removeably securing the indenter to the surface of the shape memory alloy is accomplished by clamping the indenter to the shape memory alloy.

3. The method as defined in claim 1 wherein the indenter is configured to indent the surface to a predetermined depth.

4. The method as defined in claim 1 wherein the thermomechanical training is repeated.

5. The method as defined in claim 1 wherein the shape memory alloy is selected from copper-zinc alloys, copper-aluminum alloys, copper-gold alloys, copper-tin alloys, gold-cadmium based alloys, indium-titanium based alloys, indium-cadmium based alloys, iron-platinum based alloys, iron-palladium based alloys, iron-silicon based alloys, manganese-copper based alloys, nickel-titanium based alloys, nickel-aluminum based alloys, nickel-gallium based alloys, silver-cadmium based alloys, and combinations thereof.

6. The method as defined in claim 1, further comprising:

removing the indent from the shape memory alloy;

causing a protrusion to form at the surface of the shape memory alloy at a site where the indent was removed; and causing the protrusion to return to a substantially flattened shape.

7. The method as defined in claim 6 wherein causing the protrusion to form is accomplished by heating the shape memory alloy above its austenite start temperature.

8. The method as defined in claim 6 wherein causing the protrusion to return is accomplished by cooling the shape memory alloy to below its martensite start temperature.

9. The method as defined in claim 1 wherein a stress induced on the shape memory alloy from the indenter increases when the shape memory alloy having the indenter removeably attached thereto is heated.

10. The method as defined in claim 1 wherein an array of indents is formed in the surface.

11. The method as defined in claim 1 wherein the indent has a spherical shape, a pyramidal shape, a conical shape.

12. The method as defined in claim 1 wherein the indent has a depth equal to or greater than about 2 nm.

13. A method for forming a shape memory surface, comprising:

forming at least one indent by:

cooling a shape memory alloy to its martensite phase;

removeably securing an indenter to a surface of the shape memory alloy, thereby forming the at least one indent in the surface;

heating the shape memory alloy to its austenite phase while the indenter is secured thereto; and quenching the shape memory alloy to its martensite phase while the indenter is secured thereto;

thereby removing the at least one indent from the surface of the shape memory alloy in its martensite phase;

heating the shape memory alloy to its austenite phase, thereby forming a protrusion at a site where the at least one indent was removed; and cooling the shape memory alloy to its martensite phase, thereby causing the protrusion to return to a substantially flattened shape.

14. The method as defined in claim 13 wherein the shape memory alloy is a two-way shape memory alloy, and the indent is a two-way indent.

15. The method as defined in claim 14 wherein the indent has a spherical shape, a pyramidal shape, or a conical shape.

* * * * *